US007718259B2

(12) United States Patent
Pollet et al.

(10) Patent No.: US 7,718,259 B2
(45) Date of Patent: May 18, 2010

(54) COMPOSITE YARN COMPRISING A FILAMENT YARN AND A MATRIX COMPRISING A FOAMED POLYMER

(75) Inventors: Laurence Pollet, Lyons (FR); Violaine Ducru, Lyons (FR); Stéphane Veran, Aix-les-Bains (FR); Anthony Pajot, Cremieu (FR); Stéphanie Lambour, Lyons (FR)

(73) Assignee: Chavanoz Industrie, Chavanoz (FR)

( * ) Notice: Subject to any disclaimer, the term of this patent is extended or adjusted under 35 U.S.C. 154(b) by 561 days.

(21) Appl. No.: 10/579,232

(22) PCT Filed: Nov. 25, 2004

(86) PCT No.: PCT/FR2004/003032

§ 371 (c)(1),
(2), (4) Date: Jun. 8, 2006

(87) PCT Pub. No.: WO2005/052232

PCT Pub. Date: Jun. 9, 2005

(65) Prior Publication Data

US 2007/0048523 A1 Mar. 1, 2007

(30) Foreign Application Priority Data

Nov. 25, 2003 (FR) ..... 03 13813

(51) Int. Cl.
*D02G 3/00* (2006.01)

(52) U.S. Cl. ..... 428/357; 428/378; 428/370; 428/376

(58) Field of Classification Search ..... 428/370, 428/392, 398, 401, 357, 364, 378, 376
See application file for complete search history.

(56) References Cited

U.S. PATENT DOCUMENTS

| | | | | | |
|---|---|---|---|---|---|
| 2,224,274 | A | * | 12/1940 | Powers | 57/249 |
| 3,508,990 | A | * | 4/1970 | Marzocchi | 156/166 |
| 3,551,280 | A | | 12/1970 | Kippan | |
| 3,551,281 | A | * | 12/1970 | Takaura et al. | 428/437 |
| 3,615,970 | A | * | 10/1971 | May | 156/78 |
| 3,761,346 | A | * | 9/1973 | Caroselli et al. | 428/152 |
| 3,785,919 | A | * | 1/1974 | Hickman | 428/392 |
| 4,265,972 | A | | 5/1981 | Rudner | |
| 5,278,218 | A | * | 1/1994 | Carette et al. | 524/434 |
| 2004/0167240 | A1 | * | 8/2004 | Burgun et al. | 521/79 |
| 2005/0011401 | A1 | * | 1/2005 | Bauer et al. | 106/18.11 |
| 2005/0042447 | A1 | * | 2/2005 | Conesa et al. | 428/364 |
| 2007/0048523 | A1 | * | 3/2007 | Pollet et al. | 428/375 |
| 2007/0282027 | A1 | * | 12/2007 | Fujimoto et al. | 521/137 |
| 2008/0248278 | A1 | * | 10/2008 | Fisher et al. | 428/304.4 |

FOREIGN PATENT DOCUMENTS

| | | | |
|---|---|---|---|
| FR | 2 834 302 | | 7/2003 |
| GB | 2 032 483 | | 5/1980 |
| JP | 620284435 | * | 2/1987 |

* cited by examiner

*Primary Examiner*—N. Edwards
(74) *Attorney, Agent, or Firm*—Oliff & Berridge, PLC

(57) ABSTRACT

The invention relates to a composite yarn including a filament yarn of an inorganic or organic material and a matrix of polymer material, the filament yarn being coated, extruded, or incorporated in the polymer material matrix. The matrix includes at least one foamed polymer. A composite yarn is characterized in that it has a core of an above-mentioned composite yarn and is coated, extruded or incorporated in a second polymer material matrix surrounding the core. Various methods may be used for producing the inventive yarns by coating and extrusion.

15 Claims, 1 Drawing Sheet

Figure 1:
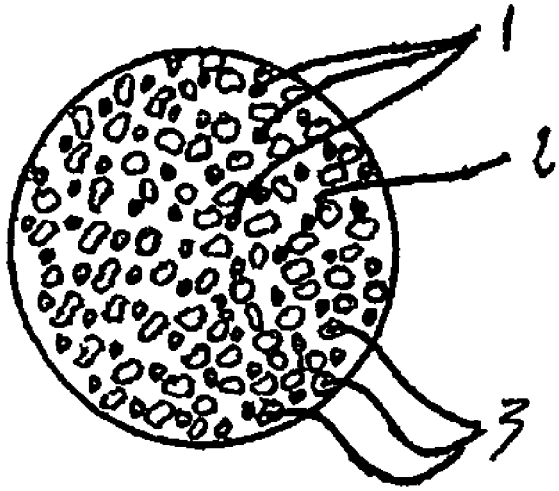

COMPOSITE YARN COMPRISING A FILAMENT YARN AND A MATRIX COMPRISING A FOAMED POLYMER

The present invention relates to a composite yarn for technical or industrial use, that can be assembled in all types of textile structures, in particular in suitable textile sheets, in order to meet any special applications or specifications, for example for the production of blinds or curtains.

In a general manner, technical composite yarns are already known, comprising:

- a core having a filament yarn, in particular made of inorganic material such as glass, or organic material such as polyester, polyamide, polyvinyl alcohol, and
- a sheath or envelope having a matrix, consisting of at least one chlorinated polymeric material, for example a polyvinyl chloride (PVC), a flame retardant mineral filler incorporated and distributed in said matrix, and a plasticizer.

Preferably, but in no way exclusively, such a yarn may be obtained by coating the core in one or two layers with a plastisol comprising the chlorinated polymeric material, for example polyvinyl chloride, and the plasticizer, and then by gelling the plastisol around the core.

Technical fabrics obtained with such yarns are subject to fire behavior requirements, defined by national or international, homologation or authorization regulations and/or procedures.

Various attempts have been made to improve the intrinsic fire behavior of these composite yarns, for example by using special plasticizers, such as organic phosphates. Unfortunately, use of such plasticizers causes a deterioration in the application characteristics (flexibility, gliding ability, etc.) of these yarns, which is harmful to their subsequent weaving and makes the latter more difficult. In addition, the incorporation of such plasticizers increases the smoke index.

Fire retardant fillers conventionally used in PVC do not allow the fireproofing behavior to be improved, without adversely impairing the other properties of the yarn, in particular the mechanical properties, and it is not possible, or no longer possible, to significantly increase the weight content of fire retardant filler unless the application characteristics of the composite yarn are allowed to suffer as previously.

These yarns must have special mechanical properties according to their subsequent application, in particular for the production of technical textiles, enabling them to be woven under satisfactory conditions, for example abrasion resistance and tensile strength and, for example, resistance to defibrillation when cut, and also enabling fabrics to be obtained that comply with the specifications required for the final textiles, for example light-screening properties and therefore fiber opacity, and weatherability when these textiles are to be used to provide external fittings to buildings, for example blinds, but also density, it being easier to install and handle them if their weight is reduced.

Concerning abrasion resistance, reference will be made for example to sheath stripping. Since the core of the yarn is not uniformly distributed in the polymeric sheath the core can leave the sheath under the effect of abrasion, and breaks can occur in the fibers forming the core, it being possible for these to break by repeated rubbing on account of their contact between one another.

These problems of mechanical strength have been partly solved by the composite yarn described in patent application 01/17047 filed in France on 28/12/2001, which describes a composite yarn consisting of fibers uniformly dispersed in a polymeric material.

This coated fire retardant composite yarn, with a glass core uniformly distributed in the polymeric material, exhibits better mechanical properties than the yarn obtained by the prior art. The tensile strength is increased by 25% and the yarn no longer loses its sheath, and the yarn obtained in this way does not defibrillate on being cut since the fibers forming the glass core are held by the polymeric material.

The glass core uniformly dispersed in the polymeric material behaves like a filler, facilitating the heat dissipation. The fire behavior is then intrinsically improved and makes it possible to reduce the fire retardant filler content in the yarn.

Since the glass core is uniformly dispersed in the polymeric material, it is also better protected from foul weather by elimination of capillary rise.

A yarn or bristle is also obtained that has glass right to its end.

However, in order to obtain the opacifying properties required for the end use of textiles obtained by weaving, opacifying fillers must be used, the opacifying fillers conventionally used being for example zinc sulfide, calcium carbonate or titanium dioxide.

These opacifying fillers are intrinsically abrasive when they are in contact with the fibers forming the core and may cause these fibers to break, in particular when composite yarns are applied by weaving or when textiles are handled.

The present invention makes it possible to limit, or even eliminate, the use of opacifying fillers in the polymeric materials used for the production of these composite yarns.

A method is known from GB 2 032 483 for obtaining a textile from a woven or nonwoven yarn, said yarn including a foaming agent which is heat-activated after weaving as crosslinking is completed, so as to obtain a textile of which the fibers are bonded because of the flattening caused by the calendering which is carried out after foaming. Apart from the fact that this method requires operations for treating the textile obtained, it does not make it possible to obtain a yarn of which the fibers are uniformly distributed in the matrix formed around the fibers.

The present invention makes it possible to solve the problems of the prior art and its subject is a composite yarn comprising a filament yarn made of an inorganic or organic material and a matrix made of polymeric material, said filament yarn being covered, coated, extruded or incorporated in said matrix made of polymeric material, characterized in that said matrix comprises at least one foamed polymer.

A covered, coated, extruded yarn or a yarn incorporated in a matrix made of polymeric material is understood to mean any yarn covered by, or imbedded in, a matrix made of polymeric material capable of being obtained by immersing, extruding, coating, or coextruding fibers and matrix, mixing the fibers followed by melting of some of the fibers, co-spinning followed by melting and any other industrial method capable of enabling a composite yarn according to the invention to be obtained.

A foamed polymer is understood to mean a polymer obtained by employing a polymeric material containing a foaming system incorporated and distributed in said matrix and making it possible to obtain an expanded or microcellular material.

The foaming system may be a chemical system or a mechanical system.

Among chemical systems, reference may be made for example to systems comprising a blowing agent that may be associated with an activator. The blowing agent may be an azodicarbonamide or a p,p'-oxybis(benzenesulfonhydrazide). The activator may be a transition metal, for example zinc, an amine, an amide or glycol, in association with azodicarbonamide. The activator may be zinc oxide, iron chloride or urea in association with p,p'-oxybis(benzenesulfonhydrazide).

Among mechanical systems, reference may be made for example to systems where the polymeric preparation is subjected to shear enabling air to be incorporated. A foam stabilizer may be added in order to stabilize the foamed polymeric preparation. This foam stabilizer may, non-exclusively, be a silicone.

The present invention thus relates to a composite yarn according to the present invention characterized in that the polymer is foamed by employing a chemical foaming system.

It also relates to said composite yarn characterized in that the polymer is foamed by employing a mechanical foaming system.

The foam obtained in the polymeric material makes it possible to opacify the latter without adversely affecting the mechanical properties of the glass core uniformly distributed in the polymeric material.

The use of a foamed polymeric material, namely one containing a foaming system, as the material forming the core, enables a yarn to be obtained that has the same properties towards light as it has when opacifying fillers, such as those previously mentioned, are incorporated, that is to say the fibers forming the filament yarn are masked and no longer allow light to pass.

Surprisingly and unexpectedly, the mechanical properties are also improved by the use of a polymeric material containing a foaming system incorporated and distributed in said matrix.

The filament yarn itself consists of one or more continuous filaments or fibers. When the yarn is of natural origin, a filament yarn is obtained by twisting the fibers, that is to say by spinning. Its chemical nature may be organic, of synthetic origin, and it may consist of any plastic that can be spun, for example polyolefins, polyesters, polyamides, polyvinyls, acrylics, it may be organic, of natural origin such as flax or cotton, or it may be inorganic, for example made of glass or silica, it being understood that the melting point of the fibers must be greater than the temperature at which the polymeric material of the matrix is employed.

The present invention also relates to a composite yarn according to the invention characterized in that the inorganic material constituting the fibers of the filament yarn is chosen from the group consisting of glass or silica.

The present invention also relates to a composite yarn according to the invention characterized in that the organic material of synthetic origin constituting the fibers of the filament yarn is chosen from the group consisting of polyolefins, polyesters, polyamides, polyvinyls and acrylics.

The present invention also relates to a composite yarn according to the invention characterized in that the organic material of natural origin constituting the fibers of the filament yarn is chosen from the group consisting of flax or cotton.

It also relates to a composite yarn according to the invention, characterized in that the fibers constituting the filament yarn are uniformly dispersed in the matrix consisting of polymeric material.

It also relates to a composite yarn characterized in that it comprises a core made of a composite yarn according to the invention, covered, coated, extruded or incorporated in a second matrix made of polymeric material formed around the core.

According to the invention, the polymeric material constituting the matrix of the core and that of the second matrix formed around the core, are of an identical or different nature.

According to the invention, the polymeric material of the second matrix formed around the core may be foamed, that is to say may comprise a foaming system identical to or different from that used in the polymeric material constituting the matrix of the core.

In one variant, it may be non-foamed, that is to say not comprising any foaming system, and this independently of the fact that its nature is identical to or different from that of the material constituting the matrix of the core.

In an alternative embodiment, the polymeric material of the second matrix formed around the core is foamed.

As polymeric material, use may be made of chlorinated polymers, silicones, polyurethanes, acrylics, polyolefins, ethylene/vinyl acetate copolymers, (EVA), ethylene-propylene-diene monomer terpolymers (EPDM), polymethylmethacrylate (PMMA), and polytetrafluoroethylene (PTFE), said polymers being capable of being processed in plastisol form or melt-processed according to the selected method.

As chlorinated polymeric material, use may be made, according to the invention, of any PVC resin capable of being plasticized and in particular one that can, as a result, be processed in plastisol form.

A chlorinated polymeric material is understood to mean either a pure chlorinated polymer or a copolymer of vinyl chloride copolymerized with other monomers, or furthermore a chlorinated polymer which is alloyed with other polymers.

Among monomers that can be copolymerized with vinyl chloride, reference will be made in particular to olefins, for example ethylene, the vinyl esters of saturated carboxylic acids, such as vinyl acetate, vinyl butyrate or maleates; halogenated vinyl derivatives such as, for example, vinylidene chloride, esters of acrylic acid or methacrylic acid such as butyl acrylate.

As chlorinated polymer, reference may be made for example to polyvinyl chloride but also to post-chlorinated PVCs, polyvinylidene chlorides and chlorinated polyolefins.

Preferably, but not exclusively, the chlorinated polymeric material according to the present invention has a halogen weight content of between 40 and 70%.

As silicone polymeric material, use may be made according to the invention of organopolysiloxanes and more particularly polysiloxane resins and elastomers with or without a diluent.

As polyurethane polymeric material, use may be made according to the invention of any material consisting of a hydrocarbon chain bearing the urethane or —NHCOO— functional group.

The invention thus relates to a composite yarn according to the invention characterized in that the polymeric material of one or of the two matrices is chosen from chlorinated polymers.

The invention thus also relates to a composite yarn according to the invention, characterized in that the polymeric material of one or of the two matrices is chosen from the group consisting of polyvinyl chloride, post-chlorinated PVCs, polyvinylidene chlorides and chlorinated polyolefins.

It thus also relates to a composite yarn according to the invention characterized in that the polymeric material of one or of the two matrices is chosen from acrylics.

It thus also relates to a composite yarn according to the invention characterized in that the polymeric material of one or of the two matrices is chosen from polyolefins.

It thus also relates to a composite yarn according to the invention characterized in that the polymeric material of one or of the two matrices is chosen from organopolysiloxanes.

The invention thus also concerns a composite yarn according to the invention characterized in that the polymeric material of one or of the two matrices is chosen from polyurethanes.

In order to satisfy certain requirements as regards fire resistance, a fire retardant filler may be added to the polymeric material, this fire retardant filler being chosen from the group consisting of zinc borate, aluminum hydroxide, antimony trioxide and zinc hydroxystannate, molybdenum compounds, halogenated derivatives, compounds with active halogens, phosphorus-containing compounds and intumescent systems.

The invention thus also concerns a composite yarn according to the invention characterized in that it additionally contains a fire retardant filler chosen from the group consisting of zinc borate, aluminum hydroxide, antimony trioxide and zinc hydroxystannate.

Other fillers may be incorporated and distributed in the polymeric material, in addition to the fire retardant filler, for example a pigmentary filler, silica, talc, glass beads and/or a stabilizing filler. In such a case, the total composition by weight of the composite yarn, in inorganic materials, is obviously modified or affected.

The composite yarns according to the invention can be obtained by coating or extrusion, whether they constitute a primary composite yarn that will serve as a core with a composite yarn comprising a second matrix made of polymeric material, or whether they consist simply of a core of filament yarn made of an inorganic or organic material and a matrix made of polymeric material comprising at least one foamed polymer.

When said composite yarns are obtained by coating, said coating can be carried out with a monomeric or polymeric liquid preparation, for example a polymeric liquid preparation obtained by melting a polymer or by dispersion, for example in plastisol form, and for example a monomeric liquid preparation consisting of a liquid monomer that will polymerize under the effect of heat or by irradiation, for example UV irradiation.

In the case where a plastisol is used, it remains possible to make use of conventional plasticizers, for example those comprising at least one phthalate, and consequently not to compromise the processing properties of the yarn as regards its subsequent weaving.

When said composite yarns are obtained by extrusion, said extrusion can be carried out with polymers in the molten state that can be processed by extrusion.

The invention relates to a method for producing a composite yarn according to the invention, characterized in that a filament yarn, obtained by spinning fibers made of an organic or inorganic material or of natural fibers, is subjected to coating with a polymeric material containing a foaming system.

It moreover also relates to a method for producing a composite yarn according to the invention, characterized in that a filament yarn, obtained by spinning fibers made of an organic or inorganic material or of natural fibers, is subjected to coating with a polymeric material containing a foaming system, and then to a second step of coating with a polymeric material containing or not containing a foaming system.

It moreover also relates to a method for producing a composite yarn according to the invention, characterized in that a filament yarn, obtained by spinning fibers made of an organic or inorganic material or of natural fibers, is subjected to coating with a polymeric material containing a foaming system, and then to a step of extruding in a polymeric material containing or not containing a foaming system.

The invention relates to a method for producing a composite yarn according to the invention, characterized in that a filament yarn, obtained by spinning fibers made of an organic or inorganic material or of natural fibers, is subjected to extrusion in a polymeric material containing a foaming system.

It moreover also relates to a method for producing a composite yarn according to the invention, characterized in that a filament yarn, obtained by spinning fibers made of an organic or inorganic material or of natural fibers, is subjected to extrusion in a polymeric material containing a foaming system, and then to a second step of coating with a polymeric material containing or not containing a foaming system.

It moreover also relates to a method for producing a composite yarn according to the invention, characterized in that a filament yarn, obtained by spinning fibers made of an organic or inorganic material or of natural fibers, is subjected to extrusion in a polymeric material containing a foaming system, and then to a second step of extrusion in a polymeric material containing or not containing a foaming system.

The invention also relates to the method for producing a composite yarn, characterized in that a filament yarn, obtained by spinning fibers made of an organic or inorganic material or of natural fibers, is subjected to a process for mechanically opening the yarn, enabling said fibers to be separated, simultaneously or prior to being coated with a polymeric material containing a foaming system.

The invention also relates to the method for producing a composite yarn, characterized in that a filament yarn, obtained by spinning fibers made of an organic or inorganic material or of natural fibers, is subjected to a method for mechanically opening the yarn enabling said fibers to be separated, simultaneously or prior to it being extruded in a polymeric material containing a foaming system.

It moreover relates to the method for producing a composite yarn, characterized in that a filament yarn, obtained by spinning fibers made of an organic or inorganic material or of natural fibers, is subjected to a method for mechanically opening the yarn enabling said fibers to be separated, simultaneously or prior to a primary coating with a liquid preparation of a monomer or polymer in the liquid state containing a foaming system, or prior to it being extruded in a polymeric material containing a foaming system, and in that the composite yarn obtained is subjected to a second coating with a monomeric or polymeric liquid preparation.

It moreover relates to the method for producing a composite yarn, characterized in that a filament yarn, obtained by spinning fibers made of an organic or inorganic material or of natural fibers, is subjected to a method for mechanically opening the yarn enabling said fibers to be separated, simultaneously or prior to a primary coating with a liquid preparation of a monomer or polymer in the liquid state containing a foaming system, or prior to it being extruded in a polymeric material containing a foaming system, and in that the composite yarn obtained is subjected to extrusion in a polymeric material.

Mechanical opening is understood to mean any method for opening fibers simultaneously or prior to coating, such as breaking, by application of an air jet or a water jet, treatment by ultrasound, application of mechanical pressure, for example crushing of the yarn, relative slowing down of the unwinding of the fibers and/or any other method known to a person skilled in the art and that is applicable, enabling the fibers to be separated in order to enable the polymeric material to penetrate inside the fibers forming said yarn. This mechanical opening may possibly be supplemented by a device for "forcing" the penetration of polymeric material between the fibers, for example with a device for guiding said polymeric material, with a jet of polymeric material, with nozzles or even with the use of a system for pressing the fibers.

The yarn obtained is opaque and the fabric obtained by weaving this yarn is effective in filtering out a large amount of light without the use of an opacifying filler.

The mechanical properties are also improved by the use of a foamed polymeric material. The tensile strength is improved compared with composite yarns previously described. The resistance to sheath removal is also improved by 100%.

The gas produced during foaming of the polymeric material is mainly nitrogen, so that the fireproofing properties are not adversely affected by this method.

The composite yarn obtained according to the present invention is also lighter, for a given diameter, than yarns previously described and produced in this way, for the same covering power, and the fabric produced from the yarn described in the present invention is lighter.

In the same way, for the same weight, a yarn is obtained with a greater diameter and therefore a fabric is obtained with better covering power.

The following comparative tables enable all these properties to be illustrated, in comparison with yarns previously described and produced.

The opacifying properties of the foamed polymeric materials have been verified in particular by photography. It has been observed that when the yarn consists of a core in which the fibers are uniformly distributed in the polymeric matrix, using a polymeric material containing a foaming system, the fibers are no longer visible and the result is comparable with that obtained by adding an opacifying filler such as zinc sulfide and titanium dioxide.

Transparency or light filtration measurements are also comparable.

FIG. 1 represents a cross section of the yarn according to the invention. A homogeneous distribution of the fibers 1 can be observed in the polymeric material preparation 2 applied in the liquid state and cooled or polymerized and foamed after application. The regular distribution of bubbles 3 between the fibers can be observed.

Figure 2:
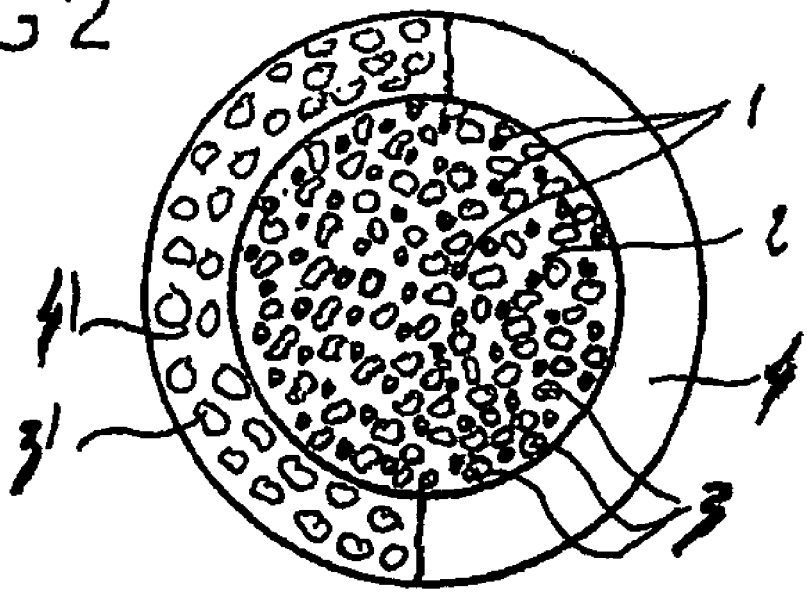

FIG. 2 represents a section of the yarn of FIG. 1 after coating by a secondary coating 4 or 4', regularly distributed around the composite yarn according to the invention. The secondary coating may be carried out with a polymeric material not comprising a foaming agent, and the layer 4 is obtained. Coating may be carried out with a polymeric material comprising a foaming agent and the layer 4' is obtained including bubbles 3'.

In the following tables the reference yarn is a yarn obtained by conventional coating, the yarn of which the fibers are uniformly distributed in the polymeric matrix being obtained by a method comprising opening the yarn before coating.

TABLE 1

| | Linear density (tex) | Tensile strength (N) | Cycles before break | Yarn diameter (μm) |
|---|---|---|---|---|
| Reference yarn | 97.0 | 26.9 | 18 | 300 |
| Yarn whose fibers are uniformly distributed in the matrix | 96.9 | 33.6 | 81 | 320 |

TABLE 1-continued

| | Linear density (tex) | Tensile strength (N) | Cycles before break | Yarn diameter (μm) |
|---|---|---|---|---|
| Yarn whose fibers are uniformly distributed in the matrix, foamed | 96.8 | 38.3 | 154 | 335 |

From the results obtained and brought together in the above table, it will be observed that the diameter and tensile strength are increased by coating with a polymeric preparation containing a foaming system.

TABLE 2

| | Linear density of glass yarn (tex) | Linear density of coated yarn (tex) | Yarn diameter (μm) | Tensile strength (N) | Cycles before break |
|---|---|---|---|---|---|
| Reference yarn | 34.0 | 93.7 | 300 | 26.9 | 18 |
| Yarn whose fibers are uniformly distributed in the matrix, foamed | 34.0 | 101 | 408 | 38.9 | 87 |

According to the results obtained, a 36% gain in diameter can be observed for a practically identical weight.

The standard yarn with a diameter of 400 μm has a weight of 165 tex: 36% gain in weight.

The standard yarn with a diameter of 350 μm has a weight of 115 tex. The yarn according to the invention has, for this diameter, a weight of 79 tex: 31% gain in weight.

Similar results can be obtained over any range of linear densities and diameters whatever the raw material.

Tests carried out have made it possible to demonstrate that the yarn according to the invention, obtained by the method described, enables M1B1 fire classifications to be achieved without a fire retardant filler in the inner layer. The following examples enable the invention to be illustrated in the case of a method by coating.

By coating a mineral yarn/continuous glass fiber/textile glass filament by the method of the invention, in order to obtain a yarn of which the fibers forming said filament yarn are uniformly distributed in the matrix, that is to say by subjecting the yarn to mechanical opening by breaking, simultaneously or prior to coating by a polymeric liquid preparation containing a foaming system, a coated composite yarn is obtained according to the invention.

The coating formulation is defined by a viscosity of between 500 and 3000 mPa·s and preferably between 1000 and 1500 mPa·s, measured at 25° C. with an RVT Brookfield viscometer at 20 rpm, spindle 4.

Coating is carried out with a formulation comprising the following products:

Matrix comprising a foamed polymer:

PVC resin 60%

DINP 26.4%

Secondary plasticizer 6%

Heat stabilizer 12%

Heat stabilizer II 3%

Viscosity reducer 1%
Azodicarbonamide blowing agent 0.6%
Kicker 1%.

Second matrix made of polymeric material formed around the core:

PVC resin 45%
PVC resin extender 15%
DINP 22%
Heat stabilizer 2%
Wetting agent 0.5%
Viscosity reducer 1%
Silicone 0.5%
Opacifying filler 1%
Fire retardant fillers 10%
Diluent 3%.

A composite yarn according to the present invention may be incorporated in any textile structures or assembled according to any required textile structures that are two-dimensional (sheets, fabrics etc) or three-dimensional (for example braids).

The composite yarn may first of all be cut and divided into elementary yarns that can be intermingled and attached to each other in the form of nonwovens, for example mats. Attachment of the intermingled elementary yarns may be obtained by impregnation with a suitable adhesive substance, or by thermofusion of the polymeric material of the sheath.

The composite yarn may then be assembled on itself in any suitable knitted textile structures, but it may be assembled with other yarns, according to the present invention or not, in order to form other two-dimensional or three-dimensional structures. In this latter case, it may consist of netting in which yarns according to the present invention are interlaced with and attached to other fibers, according to the present invention or not, and may consist of fabrics in which composite yarns according to the invention are woven with other warp and/or weft yarns, also according to the invention or not.

A quite special application of the present invention relates to the obtaining of technical fabrics, intended for the production or manufacture of blinds or curtains, both exterior as well as interior.

The invention claimed is:

1. A yarn comprising:

a filament yarn made of inorganic or organic material, and a matrix made of polymeric material comprising at least one foamed polymer, said filament yarn being covered, coated, extruded, or incorporated in said matrix made of polymeric material, wherein fibers forming the filament yarn are uniformly distributed in the matrix made of polymeric material.

2. The yarn as claimed in claim 1, wherein the polymer is foamed by employing a chemical foaming system.

3. The yarn as claimed in claim 1, wherein the polymer is foamed by employing a mechanical foaming system.

4. The yarn as claimed in claim 1, wherein the inorganic material constituting the fibers of the filament yarn is chosen from the group consisting of glass or silica.

5. The yarn as claimed in claim 1, wherein the organic material constituting the fibers of the filament yarn is chosen from the group consisting of polyolefins, polyesters, polyamides, polyvinyls, and acrylics.

6. The yarn as claimed in claim 1, wherein the organic material constituting the fibers of the filament yarn is chosen from the group consisting of flax and cotton.

7. The yarn as claimed in claim 1, wherein:

the matrix and the fibers forming the filament yarn that are uniformly distributed in the matrix together comprise a core; and the core is covered, coated, extruded, or incorporated in a second matrix made of polymeric material formed around the core.

8. The yarn as claimed in claim 7, wherein the polymeric material constituting the matrix of the core and the polymeric material of the second matrix formed around the core are the same.

9. The yarn as claimed in claim 7, wherein the polymeric material of one or of the two matrices is selected from chlorinated polymers.

10. The yarn as claimed in claim 7, wherein the polymeric material of one or of the two matrices is selected from polyvinyl chloride, post-chlorinated PVCs, polyvinylidene chlorides, and chlorinated polyolefins.

11. The yarn as claimed in claim 7, wherein the polymeric material of one or of the two matrices is selected from organopolysiloxanes.

12. The yarn as claimed in claim 7, wherein the polymeric material of one or of the two matrices is selected from polyurethanes.

13. The yarn as claimed in claim 7, wherein the polymeric material of one or of the two matrices is selected from polyolefins.

14. The yarn as claimed in claim 7, wherein the polymeric material of one or of the two matrices is selected from the group consisting of acrylics, polymethylmethacrylate (PMMA), and polytetrafluoroethylene (PTFE).

15. The yarn as claimed in claim 1, further comprising a flame retardant filler selected from the group consisting of zinc borate, aluminum hydroxide, antimony trioxide, and zinc hydroxystannate.

* * * * *